US006329334B1

(12) United States Patent
Bertleff et al.

(10) Patent No.: US 6,329,334 B1
(45) Date of Patent: Dec. 11, 2001

(54) USE OF CROSSLINKED POLYVINYLPYRROLIDONE TO INCREASE THE RATE OF DISINTEGRATION OF COMPACT PARTICULAR DETERGENTS AND CLEANERS

(75) Inventors: Werner Bertleff, Viernheim; Folker Ruchatz, Neustadt; Richard Baur, Mutterstadt; Robert Heinz, Ludwigshafen; Peter Palm, Gerolsheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/525,062

(22) Filed: Mar. 14, 2000

(51) Int. Cl.[7] ..... C11D 7/22; C11D 7/32

(52) U.S. Cl. ..... 510/445; 510/120; 510/141; 510/220; 510/224; 510/349; 510/446; 510/447; 510/451; 510/452; 510/475; 510/499

(58) Field of Search ..... 510/120, 141, 510/349, 220, 224, 445, 446, 447, 451, 452, 475, 499

(56) References Cited

U.S. PATENT DOCUMENTS

| | | | | |
|---|---|---|---|---|
| 4,256,599 | * | 3/1981 | Krisp et al. | 252/99 |
| 4,642,197 | * | 2/1987 | Kruse et al. | 252/98 |
| 4,648,882 | * | 3/1987 | Osberghaus | 8/142 |
| 4,695,397 | * | 9/1987 | Sommer et al. | 252/182 |
| 5,290,496 | | 3/1994 | Carduck et al. | 264/142 |
| 5,360,567 | * | 11/1994 | Fry et al. | 252/90 |
| 5,407,594 | * | 4/1995 | Fry et al. | 252/90 |
| 5,990,058 | * | 11/1999 | Bac et al. | 510/120 |
| 6,011,157 | | 1/2000 | Julius et al. | 546/244 |
| 6,025,315 | * | 2/2000 | Gorlin et al. | 510/224 |

FOREIGN PATENT DOCUMENTS

| | | |
|---|---|---|
| 197 10 254 | 9/1978 | (DE) . |
| 196 49 560 | 6/1998 | (DE) . |
| 196 49 565 | 6/1998 | (DE) . |
| 0 518 888 | 12/1995 | (EP) . |
| 0 340 013 | 2/1997 | (EP) . |
| WO 97/46529 | 12/1997 | (WO) . |
| WO 97/46657 | 12/1997 | (WO) . |

OTHER PUBLICATIONS

Buehler "Kollidon–Polyvinylpyrrolidine for the Pharmaceutical Industry"BASF (1993) pp. 156–187.*

* cited by examiner

*Primary Examiner*—Gregory Delcotto
(74) *Attorney, Agent, or Firm*—Keil & Weinakuf

(57) ABSTRACT

The invention relates to the use of crosslinked polyvinylpyrrolidone as an additive to compact, particulate detergents and cleansers for the purpose of increasing the rate of disintegration thereof when brought into contact with water, to the particles of crosslinked polyvinylpyrrolidone having a particle size of from 50 to 400 $\mu$m, to a process for the preparation of the compact, particulate detergents and cleansers, and also to the compact, particulate detergents and cleansers themselves.

5 Claims, No Drawings

USE OF CROSSLINKED POLYVINYLPYRROLIDONE TO INCREASE THE RATE OF DISINTEGRATION OF COMPACT PARTICULAR DETERGENTS AND CLEANERS

BACKGROUND AND PRIOR ART

The invention relates to the use of crosslinked polyvinylpyrrolidone as an additive to compact, particulate detergents and cleansers for the purpose of increasing the rate of disintegration thereof when brought into contact with water, to the particles of crosslinked polyvinylpyrrolidone having a particle size of from 50 to 400 μm, to a process for the preparation of the compact, particulate detergents and cleansers, and to the compact, particulate detergents and cleansers themselves.

Dense or compact detergent and cleanser compositions are prepared by various agglomerating, compacting or pelletizing techniques. In the case of compact detergent and cleanser products present for example in the form of pellets, it is difficult to establish the correct balance between adequate strength properties and sufficiently rapid dissolution or disintegration thereof when subjected to the action of water. For example, detergent pellets which have been placed in the run-in chambers of a washing machine, must disintegrate over a period of less than one minute after being contacted with water. When there is only a slight degree of compaction of the detergent pellets a satisfactory rate of disintegration is achieved, in use, but frequently at the expense of the desired breaking resistance or abrasion resistance. Pellets thus prepared have only a small breaking resistance and tend to crumble and break to pieces during transport. On the other hand, excessive compaction or compression exerted during production of detergent pellets leads to unsatisfactorily long disintegration or dissolution times of the detergent pellets in use.

Compact or ultracompact detergents and cleansers are known, cf EP-A 340,013, EP-A 0,518,888, DE-A 19,649,560 and DE-A 19,649,565. In order to improve the rate of dissolution of particulate detergent formulations, use is made of solubilizing additives comprising, for example, copolymers of hydrophobic and hydrophilic monomers, such as copolymers of styrene and acrylic acid, cf WO-A 97/46657. According to the statements made in WO-A 97/46529 the rate of dissolution of particulate washing formulations is achieved by the use of, for example, addition products of ethylene oxide and/or propylene oxide and polyols.

Methods of producing pharmaceutical tablets reveal numerous possibilities for the preparation of pellets showing the desired strength properties and disintegration times. The main active mechanisms causing the disintegration of pellets are described to be wetting, capillary response (wicking) and swelling, cf Drug Development and Industrial Pharma, Vol. 6 (5) 511–536 (1980). Of the products which improve the solubility of tablets, mention has also been made of chemically crosslinked, swelling products such as microcrystalline crosslinked carboxymethylcellulose, crosslinked sodium carboxymethylstarch or crosslinked polyvinylpyrrolidone (cf Volker Buehler, Kollidon—Polyvinylpyrrolidone for the pharmaceutical industry, BASF, August 1993, pp 156 et seq).

By reason of the content of non-ionic surfactants and other low-melting wax-like, plastically deformable compositions in detergents, the addition of tablet bursters, which are known from pharmacy, to compact detergents and cleansers is rarely successful, particularly in the case of compact detergents used for washing laundry goods.

It is known that compact detergents and cleansers (shaped particles showing detergent and cleanser activity) have an increased rate of disintegration when they contain bursting agents in a special, granulated form, as are known in pharmacy and are capable of increasing the porosity or capillarity of the shaped particles and possess high adsorption capacity for water, DE 197 10 254 A1).

Compact detergents and cleansers prepared in this manner do indeed show an increased, but not sufficiently high, rate of disintegration, particularly in the case of compact detergents and cleansers which have been subjected to relatively high compacting pressures to increase their dimensional stability and breaking resistance. Furthermore, the thus prepared compact detergents and cleansers suffer from the drawback that the bursting agent must be converted to a granular form in an elaborate process step prior to compaction.

BRIEF SUMMARY OF THE INVENTION

It is thus an object of the present invention to provide additives which further increase the rate of disintegration of compact, particulate detergents and cleansers and do not suffer from the above drawbacks.

This object is achieved in the present invention by the use of crosslinked polyvinylpyrrolidone as an additive to compact, particulate detergents and cleansers to increase the rate of disintegration thereof when brought into contact with water, the particles of the crosslinked polyvinylpyrrolidone having a particle size of from 50 to 400 μm.

By compact, particulate detergents and cleansers we mean, for the purposes of the present invention, shaped particles showing detergent or cleanser activity, in particular pellets such as detergent pellets, dishwashing pellets, bleaching pellets, stain removing pellets or water-softening pellets, in particular detergent pellets for laundry goods for domestic use, in particular for machine use.

The term "shaped particle" is not limited to pellets.

Theoretically, any three-dimensional shape, such as pellets, spheres, extrudates, rings, bars or scales are possible, such as can be imposed on the starting materials optionally by means of a surrounding container.

By crosslinked polyvinylpyrrolidone we preferably mean the crosslinked polyvinylpyrrolidone used as tablet bursting agent in the pharmaceutical industry, such as Kollidon CL® or Luvicross® (trade name of BASF Aktiengesellschaft, Ludwigshafen, cf Volker Buehler, Kollidon—Polyvinylpyrrolidone for the pharmaceutical industry, BASF August 1993, pp 156 et seq).

DETAILED DESCRIPTION OF THE INVENTION

The particles of the crosslinked polyvinylpyrrolidone used have a particle size of from 50 to 400 μm and preferably from 80 to 300 μm.

In accordance with the invention, preference is particularly given to the use of crosslinked polyvinylpyrrolidone,in which the particles of said crosslinked polyvinylpyrrolidone have a particle size of from 50 to 400 μm and preferably from 80 to 300 μm, and at least 10 wt % and preferably 15 wt %, more preferably 25 wt %, of the particles have a particle size of less than 200 μm.

In order to achieve this preferred particle-size distribution, the polyvinylpyrrolidone solids (Kollidon CL® or Luvicross®), which are produced in known manner so as to show a broad particle-size distribution, by polymerization, such as popcorn polymerization, and drying, are sorted directly and without further granulating steps to give the desired particle-size distribution by appropriate means of classification, such as by sifting or pneumatic classification. Drying is carried out in known manner, for example by drum drying.

The invention also relates to compact, particulate detergents and cleansers which contain the aforementioned crosslinked polyvinylpyrrolidone in amounts of from 0.5 to 20 wt % and preferably from 0.5 to 10 wt %, more preferably from 0.5 to 5 wt %, to increase the rate of disintegration thereof when they are brought into contact with water.

In a preferred embodiment, the particles of crosslinked polyvinylpyrrolidone have, in accordance with the preferred use thereof, a particle size of from 50 to 400 μm and at least 10 wt % of the particles have a particle size of less than 200 μm.

Compact, particulate detergents and cleansers have already been explained above. Preferred compact, particulate detergents and cleansers are shaped particles suitable for washing laundry goods, that is to say compact, particulate detergents and cleansers which contain, in addition to the crosslinked polyvinylpyrrolidone as proposed by the invention, any conventional constituents of detergents used for washing laundry goods.

The compact, particulate detergents and cleansers of the invention are made in known manner by shaping, in particular by compacting or compressing, preferably by briquetting, the pulverulent constituents (crosslinked polyvinylpyrrolidone as bursting agent and conventional constituents of detergents or cleansers, bleaching agents and water softeners) ("Tablettieren: Stand der Technik", S ÖFW-Journal, 1996, 122nd year of issue, pp 1016–1021).

Common constituents of compact, particulate detergents and cleansers are for example ionic, non-ionic, cationic, amphoteric and zwitterionic surfactants, inorganic and organic, water-soluble or water-insoluble builders and co-builders, bleaching agents, in particular peroxy bleaching agents, but also active chlorine compounds, which are advantageously coated, bleach activators and bleaching catalysts, enzymes and enzyme stabilizers, antifoaming agents, antigreying agents, dye transfer inhibitors, optical brighteners, substances preventing soil redeposition on textiles, ie soil repellents, and also conventional inorganic salts such as sulfates and organic salts such as phosphonates, optical brighteners, colorants and perfumes or corrosion inhibitors.

Preferred detergents are so-called compact detergents, which contain as constituents at least one surfactant and at least one builder.

In order to prepare the compact, particulate detergents and cleansers of the invention, the aforementioned crosslinked polyvinylpyrrolidone is added, to increase the rate of disintegration, preferably in amounts of from 0.5 to 20 wt %, more preferably from 0.5 to 10 wt % and most preferably from 0.5 to 5 wt %, based on the weight of the shaped particles showing detergent and cleanser activity, to the pulverulent conventional detergent or cleanser constituents, bleaching agents and water softeners or their pulverulent precursors or partial components prior to the final compacting or pelletizing step. The pulverulent, conventional constituents of detergents or cleansers, bleaching agents and water softeners, their precursors or partial components, exist for example in the form of powders, granules or extrudates. They have particle sizes ranging, for example, from 200 μm to 3 μm and preferably from 250 μm to 2 mm.

After the pulverulent, conventional detergent or cleanser constituents, bleaching agents and water softeners or the partial components thereof have been mixed with the crosslinked polyvinylpyrrolidone used according to the present invention, the mixture, optionally following further mixing steps, is processed to form aggregated, compact shaped units showing an increase in mass density, for example by extrusion or briquetting. There are thus obtained, for example, pellets, spheres, extrudates, rings or scales. The mixture can be divided up in such a manner that for example the pellets or spheres obtained are of a magnitude such that only one to three pellets or spheres are necessary for one wash in a washing machine, for example. The diameter of the shaped units produced from the mixtures thus formed is for example from 1 to 50 mm and preferably from 2 to 35 mm.

The use of crosslinked polyvinylpyrrolidone as an additive for compact particulate detergents and cleansers in accordance with the present invention leads to considerable increase in the rate of disintegration of such compact, particulate detergents and cleansers when they are brought into contact with water. Even break-resistant, strongly compressed shaped units are disintegrated within a few seconds. This makes it not only possible to add the compact, particulate detergents and cleansers directly to the aqueous liquor of a mechanical process by means of dosing apparatus but also to place the compact, particulate detergents and cleansers directly in the water chute of commercial domestic machines, particularly washing appliances.

The invention is described below with reference to the following examples.

EXAMPLES 1 to 4

A pulverulent, granulated detergent of composition A given below (bulk density ca 770 g/L) and crosslinked polyvinylpyrrolidone (Examples 1 and 2: particle size 80 to 400 μm, Examples 3 and 4: particle size less than 100 μm) were worked in a mixer to give homogeneous blends, which were compressed to pellets in a conventional eccentric press (sold by Korsch, type EK 0 DMS) under the conditions stated in the table, the resulting pellets weighing ca 3 g (diameter 20 mm). All of the mixtures contained 5% of the crosslinked polyvinylpyrrolidone to be used according to the present invention. The pellets were tested to determine their disintegration characteristics in water (cf table).

The hardness of the pellets was determined with the aid of a pellet tester sold by Kraemer, Darmstadt. This instrument measures the horizontal force necessary to break a pellet.

To determine the solubility, use was made of a disintegration timer sold by Erweka. For this purpose the pellets were placed in a disintegration cage tester having a screen base and agitated in a temperature-controlled water bath (reciprocation rate: 30 up-and-down movements per minute over a distance of 20 mm). The time required to remove all traces of detergent from the screen was determined. The results are given in the table below.

Detergents of composition A (all percentages by weight)

| | |
|---|---|
| alkylbenzene sulfonate | 8 |
| 30 potassium coconut soap | 1.2 |
| nonionic surfactant | 6(1 mol of $C_{13}$–$C_{15}$ fatty alcohol |

-continued

| | |
|---|---|
| | reacted with 7 mols of ethylene oxide |
| zeolite A | 35 |
| sodium carbonate | 8 |
| sodium metasilicate × $5.5H_2O$ | 6 |
| sodium citrate | 4 |
| sodium percarbonate | 18 |
| teteraacetylethylenediamine(TAED) | 5 |
| complexing agent | 0.3(ethylenediamine tetramethylene phosphonate) |
| poly(acrylic acid-co-maleic acid) 70:30 mol. wt. 70,000 | 4 |
| sodium sulfate | |
| other constituents | 2.5(perfumes, antifoaming agents, enzymes, opt. brighteners) |
| bulk density ca 770 g/L | |
| particle size ca 700–1000 μm. | |

Comparative Examples 1 and 2

For the purpose of comparison, pellets weighing ca 3 g and having a diameter of 20 mm were made from the pulverulent, granulated detergent A and tested to ascertain their disintegration properties in water (see table below). The readings were taken as described in Examples 1 to 4.

Properties of the detergent pellets

| Example | Detergent A containing PVD of particle size | Compacting force in kN | Compacting force in MPa | Breaking force in N | Disintigration time |
|---|---|---|---|---|---|
| 1 | 80 to 400 μm | 6.48 | | <3 | <5 seconds |
| 2 | 80 to 400 μm | 29.41 | | 12 | <10 seconds |
| 3 | <100 μm | 5.98 | | <3 | 30 minutes |
| 4 | <100 μm | 26.39 | | 14 | 30 minutes |
| Comp. Ex. 1 | no PVD added | 4.09 | 13 | 8 | >30 minutes |
| Comp. Ex. 2 | no PVD added | 7.97 | 25 | 11 | >30 minutes |

It is clearly shown that the addition of the crosslinked polyvinylpyrrolidone, in the present invention, in the form of particles having a diameter of from 80 to 400 μm results in distinctly faster disintigration of the detergent pellets and distinctly higher breaking resistances thereof.

We claim:

1. A method of using crosslinked polyvinylpyrrolidone as an additive to compact, particulate detergents and cleansers to increase the rate of disintegration thereof when brought into contact with water, wherein the crosslinked polyvinylpyrrolidone particles have a distribution of particle size in which the particles range in size from 50 to 400 μm.

2. A method as defined in claim 1, wherein at least 10 wt % of the particles of crosslinked polyvinylpyrrolidone have a particle size below 200 μm.

3. A method as defined in claim 1, wherein the particles are obtained by direct classification of the polyvinylpyrrolidone solids produced by polymerization and drying.

4. A compact, particulate detergent or cleanser containing crosslinked polyvinylpyrrolidone in a concentration of from 0.5 to 20 wt % to increase the rate of disintegration when brought into contact with water, wherein the particles of said crosslinked polyvinylpyrrolidone have a distribution of particle size in which the particles range in size from 50 to 400 μm, with at least 10 wt % of said particles having a particle size below 200 μm.

5. A process for the manufacture of a compact, particulate detergent or cleanser containing crosslinked polyvinylpyrrolidone as bursting agent, wherein crosslinked polyvinylpyrrolidone is mixed, in a concentration of from 0.5 to 20 wt %, with the pulverulent constituents of the detergent, wherein the particles of said crosslinked polyvinylpyrrolidone have a distribution of particle size in which the particles range in size from 50 to 400 μm, and at least 10 wt % of said particles have a particle size below 200 μm, after which the mixture is compressed to convert it to a compacted form.

* * * * *

UNITED STATES PATENT AND TRADEMARK OFFICE

CERTIFICATE OF CORRECTION

PATENT NO. : 6,329,334 B1
DATED : December 11, 2001
INVENTOR(S) : Bertleff et al.

It is certified that error appears in the above-identified patent and that said Letters Patent is hereby corrected as shown below:

Title page,
Insert the following missing priority information:
-- [30] Foreign Application Priority Data
Mar. 17, 1999 (DE) …… 199 12 031.5 --.

Signed and Sealed this

Thirteenth Day of August, 2002

*Attest:*

*Attesting Officer*

JAMES E. ROGAN
*Director of the United States Patent and Trademark Office*